US007516818B2

(12) United States Patent
Harris et al.

(10) Patent No.: US 7,516,818 B2
(45) Date of Patent: Apr. 14, 2009

(54) ITEM ACCUMULATION AREA DIVIDER FOR A CHECKOUT COUNTER

(75) Inventors: Richard Hunter Harris, Raleigh, NC (US); Brian Hargrove Leonard, Durham, NC (US); Robert Paul Tennant, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 457 days.

(21) Appl. No.: 11/219,226

(22) Filed: Sep. 2, 2005

(65) Prior Publication Data

US 2007/0051561 A1 Mar. 8, 2007

(51) Int. Cl.
*A63F 9/02* (2006.01)

(52) U.S. Cl. ..... 186/59; 160/238

(58) Field of Classification Search ..... 160/238; 186/59–69; 52/729.3; 53/175, 157
See application file for complete search history.

(56) References Cited

U.S. PATENT DOCUMENTS 2,569,711 A * 10/1951 Foster ..... 186/68
2,856,647 A * 10/1958 Beckman et al. ..... 52/540
3,690,411 A 9/1972 Potrafke ..... 186/1 A
4,956,630 A * 9/1990 Wicker ..... 340/433
5,226,557 A * 7/1993 Nelson ..... 206/523
5,706,912 A 1/1998 Holland ..... 186/68
6,119,878 A * 9/2000 Zen ..... 211/94.01
2005/0139710 A1* 6/2005 Prismall ..... 242/371

* cited by examiner

*Primary Examiner*—Jeffrey A Shapiro
(74) *Attorney, Agent, or Firm*—Jason O. Piche

(57) ABSTRACT

The present invention provides a checkout system which comprises an item accumulation (bagging) area which is partitioned into two or more sections using a flexible divider. The flexible divider extends from the entry zone of the accumulation area to a point on the boundary of the accumulation zone, but is longer than required to achieve this. When items are introduced into one section of the bagging area, if the items push against the flexible divider, for example due to weight of numbers, the divider flexes into the other section thereby making more space available in the current section for the items. Optionally the flexible divider is movable between two positions in the entry zone such that it further acts as a diverter for diverting items into one or other of the two sections and preferably a motor is used to automatically perform the movement.

6 Claims, 5 Drawing Sheets

ITEM ACCUMULATION AREA DIVIDER FOR A CHECKOUT COUNTER

BACKGROUND OF THE INVENTION

In a scan and pass checkout system the goods/items of a customer are first scanned in a scanning area and then moved to a bagging or accumulation area, often by means of a endless conveyor belt. However, it is both undesirable to mix the goods of a first customer with the goods of a second customer in the bagging area and to wait for a first customer to remove all of their goods from the bagging area before serving the next customer. As a result, a problem exists in how to prevent the mixing of goods whilst maintaining an acceptable throughput of customers.

U.S. Pat. No. 2,569,711 to Allan D. Foster discloses using a rigid divider with a hingedly attached rigid deflector. The divider partitions the bagging area into roughly to equal sections and the deflector is manually moved between two positions to deflect goods from an endless conveyor to one or other partition of the bagging area.

U.S. Pat. No. 3,690,411 to Werner Potrafke discloses a checkout stand with three fixed accumulation areas. Goods are moved to two of the areas using a conveyor belt and inclined slide table, and to the third area using just an inclined slide table U.S. Pat. No. 5,706,912 to Leon King Manufacturing Co., Inc., discloses a checkout stand with primary and secondary accumulation zones, primary and secondary endless conveyors, and a diverter. Goods placed on one side of the primary conveyor are moved to the primary accumulation area whilst goods place on the other side of the primary conveyor are deflected onto the secondary conveyor by the diverter and moved to the secondary accumulation area.

Two other known solutions are a carousel bagging area, and a dividing "stick" which is placed between the goods of different customers.

SUMMARY OF THE INVENTION

In the existing checkout systems either the size of sections/partitions in the bagging/accumulation zone/area are fixed or unattached/loose parts are required. As a result these solutions either do not allow for goods of different customers requiring more space than a defined bagging section or require manual placement of a stick which can easily be misplaced or lost. Accordingly it is an object of the present invention to provide a checkout system in which sections of the bagging area can be varied in size to allow for different customers requiring different size bagging area sections for their goods/items and further which uses no loose parts.

Accordingly, according to a first aspect the present invention provides a checkout system comprising: an accumulation area for the accumulation of items, the accumulation area having an entry zone through which items enter the accumulation area and a boundary to retain items in the accumulation area; and an elongate flexible divider coupled at one end to the boundary, the divider for partitioning the accumulation area into two partitions; wherein the flexibility of the divider enables the relative sizes of the two partitions to be varied to accommodate a variable number of items.

Preferably the other end of the flexible divider is moveable between two positions in the entry zone so that it further serves for directing items from the entry zone into one or other of the partitions. Preferably a motor is used to automatically move the other end between these two positions. Alternatively the other end is slideably mounted in the entry zone and can be moved manually between the two positions.

Optionally the end of the flexible driver coupled to the boundary is moveable between two positions along the boundary. This enables a greater variation in the relative sizes of the partitions.

The flexible divider can take any form which makes it flexible along its length whilst making it sufficiently stiff, whilst in use, to remain substantially upstanding relative to the surface of the bagging area along its length so that it is effective at keeping items in each of the two partitions separate. Preferably the flexible divider comprises a flexible plastic strip which is corrugated along its length and substantially perpendicular to its length. The corrugations provide the required stiffening of the flexible divider. Alternatively, for example, the flexible divider comprises a flexible middle section with rigid sections at each end. Alternatively, for example, the flexible divider comprises a plurality of alternate rigid and flexible sections. Optionally at least one such flexible section is made from an elastic material.

Optionally at least one end of the flexible divider is mounted using a retraction mechanism which houses an extension section of the flexible divider. The extension section is dispensed when a force is applied to the flexible divider and retracted when the force is removed. Preferably, if an end of the divider is coupled to the entry zone of the checkout system, this end is mounted using a retraction mechanism.

According to a second aspect the present invention provides a checkout system comprising: an accumulation area for the accumulation of items, the accumulation area having an entry zone through which items enter the accumulation area and a boundary to retain items in the accumulation area; an elongate flexible divider coupled at one end to the boundary, the divider for partitioning the accumulation area into two partitions; and a motor coupled to the other end of the flexible divider and configured to move the flexible divider between the two positions for directing items from the entry zone into one or other of the partitions; wherein the flexibility of the divider enables the relative sizes of the two partitions to be varied to accommodate a variable number of items and an end of the flexible divider is mounted using a retraction mechanism which houses an extension section of the flexible divider, wherein the extension section is dispensed when a force is applied to the flexible divider and retracted when the force is removed.

BRIEF DESCRIPTION OF THE DRAWINGS

Some of the purposes of the invention having been stated, others will appear as the description proceeds, when taken in connection with the accompanying drawings, in which.

Note that in the figures like numbers are used for like parts.

DESCRIPTION OF THE PREFERRED EMBODIMENT OF THE PRESENT INVENTION

Figure 1:
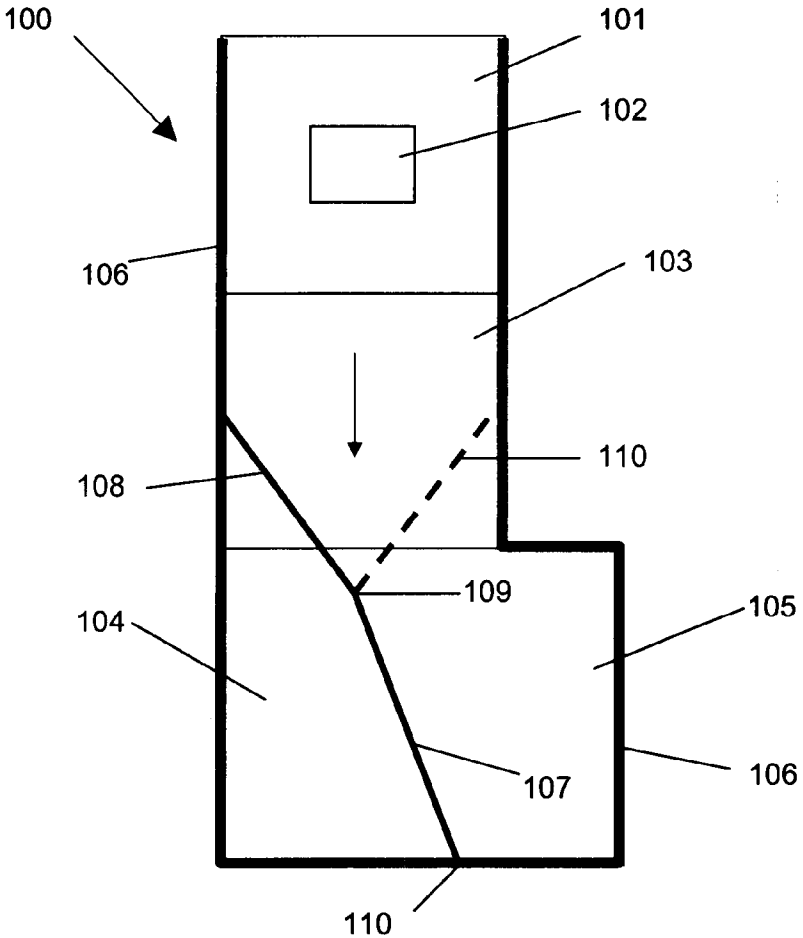
FIG. 1 is a plan view of a checkout system of the prior art.

FIG. 1 is a plan view of a checkout system 100 of the prior art and in which the preferred embodiment of the present invention will be implemented. The checkout system 100 includes a scanning area 101 with an imbedded scanning device 102 for scanning goods to be purchased by a customer. Scanned goods are placed on endless conveyor belt 103 and moved to a downwardly inclined bagging area which comprises two sections 104 and 105. A perimeter wall 106 runs along the outside edges of the checkout system to prevent items from falling from the system. The bagging area is partitioned into the two sections by a rigid divider 107 which has one end anchored at anchor point 110 at the end perimeter of the bagging area. The other end of the rigid divider 107 is attached to a moveable rigid diverter 108 by a hinge at hinge point 109. The rigid diverter is moveable between two positions, in the position shown it diverts goods from the endless conveyor 103 into section 105 of the bagging area, and in the position shown by dashed line 110 it diverts goods from the endless conveyor 103 into section 104 of the bagging area.

A problem of the checkout system 100 is that the relative sizes of the sections 104 and 105 are fixed according to the position of the diverter and this may lead to a problem if the number of goods being purchased by a customer requires a larger area than the section into which they are being conveyed. Further, if the goods being purchased by another customer require a smaller area, the checkout counter is larger than required and floor space is wasted.

Figure 2:
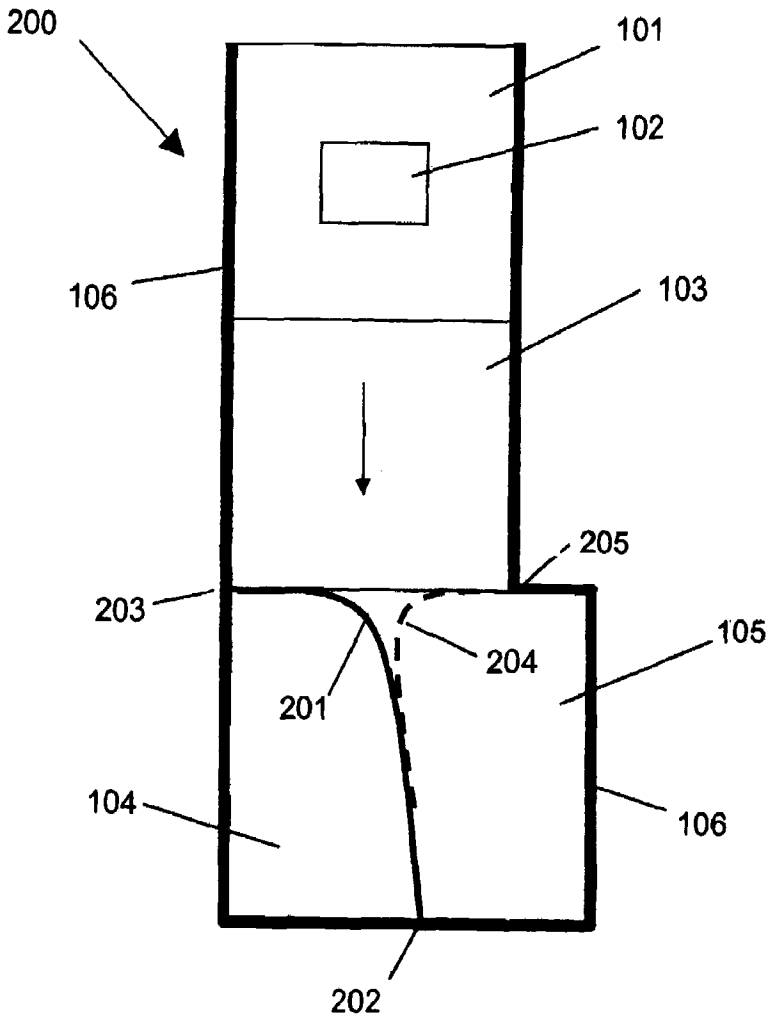
FIG. 2 is a plan view of a checkout system with a flexible divider according to the preferred embodiment of the present invention.

FIG. 2 is a plan view of a checkout system 200 according the preferred embodiment of the present invention. Checkout system 200 is the checkout system of FIG. 1 modified to replace the divider and diverter with a flexible divider 201. The flexible divider 201 is made from a plastic material which is flexible to bending along its length such that it will bend laterally when, for example, purchased items press against it, but is otherwise relatively stiff such that it is an effective divider. The flexible divider 201 has a fixed end 202 which is anchored at the end perimeter of the bagging area, and a moveable end which is moveable between two positions 203 and 205 at either side of the entry zone to the bagging area. Further the moveable end of the flexible divider is coupled to a motor (not shown) which is configured to move the moveable end of the flexible divider between the two positions 203 and 205 and further to stall before enough force is exerted, for example, to harm a customer's hand which might be in its way. The flexible divider is longer than the straight distance between anchor point 202 and either positions 203 and 205 so that the relative sizes of bagging areas 104 and 105 may be varied, for example, by applying an appropriate side force at some point along the flexible divider's length whilst its ends are held in position. In the position of the flexible divider shown, with the moveable end at position 203, it will divert goods into bagging area 105, and with the flexible divider in the position shown by dashed line 204, with the moveable end in position 205, it will divert goods into bagging area 104.

Preferably the flexible divider 201 is approximately equal to the length of the perimeter wall 106 between anchor point 202 and point 203, and to the length of the perimeter wall 106 between anchor point 202 and point 205, these lengths preferably being equal. This allows the bagging area available for a customers order be the total of area of bagging areas 104 and 105, irrespective of which particular bagging area is used.

Note that in an alternative embodiment the moveable end of the divider 201 is slideably mounted to the entry zone, such that it may be manually slid between positions 203 and 205. In another alternative embodiment the moveable end can move freely between the two positions 203 and 205. In yet another embodiment the fixed end of the flexible divider which is anchored at anchor point 202, is alternatively slideably mounted to allow lateral movement along the end perimeter of the bagging area.

For example, with reference to FIG. 2, when using checkout system 200 the items of a first customer are scanned and conveyed into bagging section 105 where gravity and subsequently scanned and conveyed items force previously scanned and conveyed items toward the end of the bagging area. Due to a large number of customer items and the flexible nature of the flexible divider 107, the divider bulges into bagging section 104 such that the size of bagging section 105 is increased to accommodate the large number of items. Once all items are scanned and the customer order is paid, the movable end of the flexible divider is moved from position 203 to position 205. Now the items of a second customer are scanned and conveyed into bagging section 104 whilst the items of each customer remain separated by flexible divider 107. As the first customer removes items from bagging area 105 the amount of space required for the first customer items is reduced leaving space for the flexible divider to bulge into bagging section 105 to increase the size of bagging area 104 if the second customer items require such additional space. Accordingly the flexibility of the flexible divider allows successive customer items to use the available bagging area in proportion to the relative size and number of items.

Figure 3A:
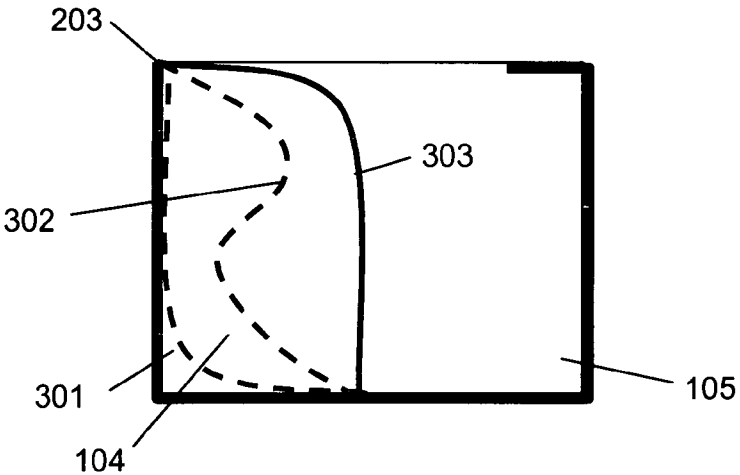
FIGS. 3*a* and 3*b* illustrate positions which the flexible divider of FIG. 2 may attain in use.
Figure 3B:
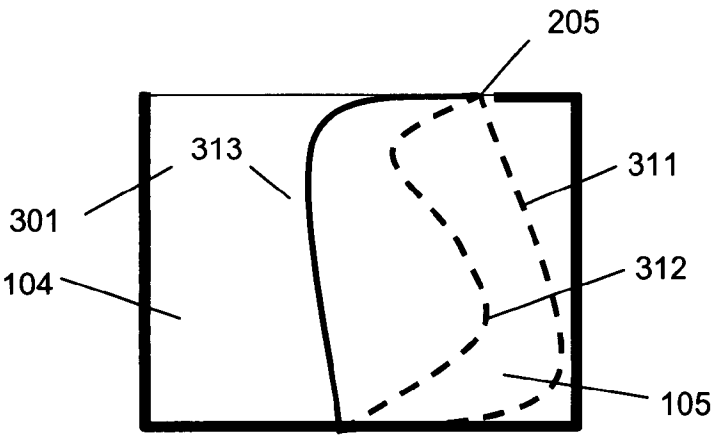

FIGS. 3*a* and 3*b* are plan views of the bagging area of FIG. 2 with a flexible divider. The figures illustrate examples of different positions a flexible divider may attain in order to vary the size of bagging sections 104 and 105 of the bagging area in order to accommodate different amounts of goods. In FIG. 3*a* the moveable end of the flexible divider is at position 203 and for example the flexible divider may start in position 303, move through position 302 and finally to position 301 as the size and number of goods conveyed to bagging section 105 require additional space. FIG. 3*b* illustrates similar example positions but with the moveable end of the flexible divider in position 205. For example the flexible divider may start in position 313, move through position 312 and finally to position 311 as the size and number of goods conveyed to bagging section 104 require additional space.

Note that a skilled person will realize that the positions of the figures shown in FIG. 3 are examples and in practice the divider may attain many other different positions and further the positions attained will depend on the make-up of the flexible divider and its degree of flexibility. The invention is not limited to any particular position or set of positions.

Figure 4A:
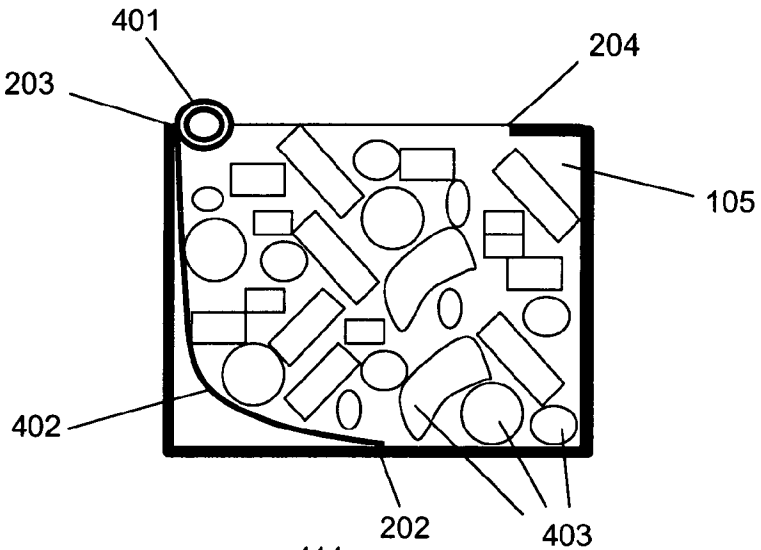
FIGS. 4*a* and 4*b* illustrates a bagging area with a flexible divider and a divider retraction mechanism according to an alternative embodiment of the present invention.
Figure 4B:
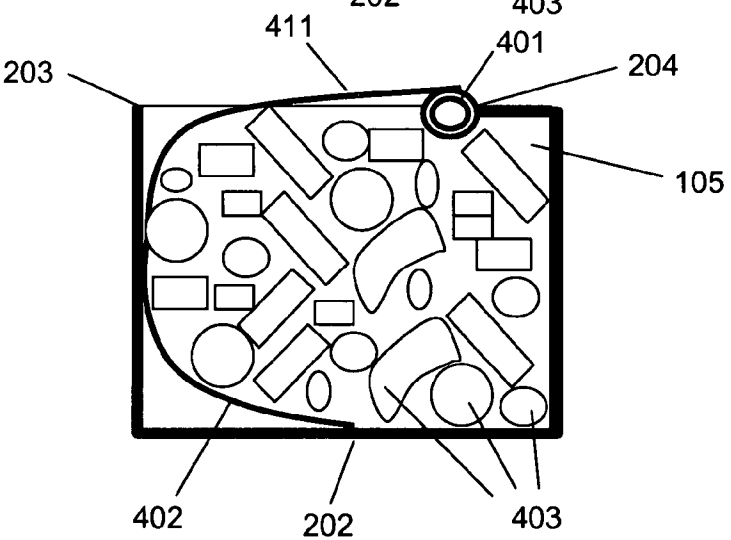

FIGS. 4*a* and 4*b* illustrate an alternative embodiment of the present invention. In this embodiment a retraction mechanism 401 is used to vary the length of the flexible divider 402. FIG. 4*a* shows a large customer order 403 in bagging area 105 and which fills almost the entire bagging area. On completion of the order the moveable end of the flexible divider is moved from position 203, as shown in FIG. 4*a* to position 205, as shown in FIG. 4*b*, and as a result an extension section 411 of the flexible divider is dispensed from retraction mechanism 401. The length of the extension section is approximately equal to the distance between positions 203 and 205. Further the retraction mechanism is resilient such that the extension section is gradually dispensed by the resisting forces of items from the customer order and will gradually retract as such forces are removed. This also ensures that only a sufficient portion of the extension section is dispensed to accommodate the customer order. Alternatively a retraction mechanism maybe mounted at position 202 either instead of, or in addition to, retraction mechanism 401.

Note that the total length of the flexible divider including the extension section is approximately equal to the perimeter length from position 202 to 203 plus the length from position 203 to 205. Accordingly the relative lengths of the non-extension and extension section of the flexible divider may be varied to meet this requirement. For example in an alternative embodiment the length of non extension part could be the straight line distance from position 202 to position 203. In this embodiment a portion of the extension section may be dispensed under the force of an item from a customer order as it enters the bagging area or is moved by another item as it enters the bagging area.

Figure 5A:
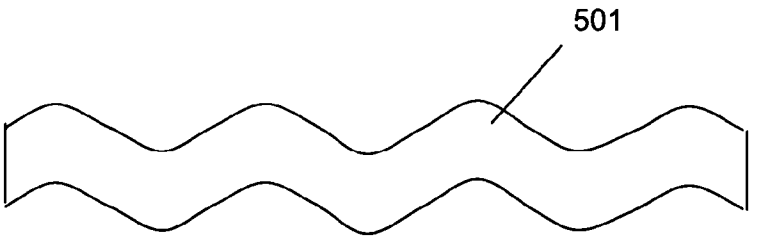
FIGS. 5*a*, 5*b*, and 5*c* illustrate various embodiments of the flexible divider.
Figure 5B:
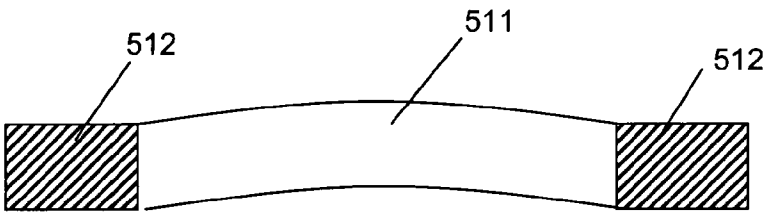
Figure 5C:
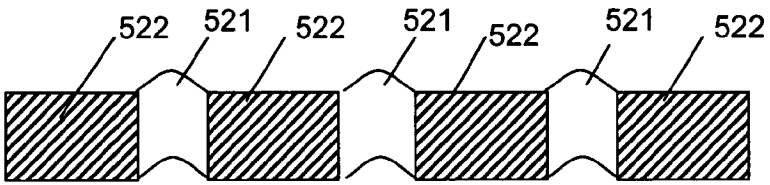

FIGS. 5*a*, 5*b*, and 5*c* illustrate different embodiments of a flexible divider of the present invention. FIG. 5*a* is the preferred embodiment of the present invention and shows a vertically corrugated plastic belt 501. The plastic is flexible along its length whilst corrugations add stiffness such that the flexible divider may be effective as a divider by, in use, remaining substantially perpendicular to the surface of the bagging area.

FIG. 5*b* shows a flexible divider with a middle flexible section 511 and rigid sections 512 at either end. Note that the relative lengths of flexible section 511 and each of the rigid sections 512 are not limited by the present invention, although the length of the flexible section must be sufficient to enable the divider to flex such that the relative sizes of the bagging sections which it partitions can be varied to accommodate different numbers and/or sizes of goods. For example the flexible section 511 may be a section of the corrugated plastic belt shown in FIG. 5*a*.

FIG. 5*c* shows a flexible divider with multiple flexible sections 521 and rigid sections 522. Note that the number and relative lengths of flexible sections 521 and each of the rigid sections 522 are not limited by the present invention subject to enabling the divider to flex such that the relative sizes of the bagging section which it partitions can be varied to accommodate different numbers and/or sizes of goods. For example, in this embodiment, if the rigid and flexible sections are configured to provide sufficient stiffness such that the flexible divider may be effective as a divider by, in use, remaining substantially perpendicular to the surface of the bagging area, one or more of the flexible sections may, for example, be made from an elastic material which allows the divider to stretch along its length. In some embodiments this stretching may replace the retraction mechanism described with reference to FIGS. 4*a* and 4*b*.

Note that a skilled person will realize that many variations of the preferred embodiment of the present invention are possible within the scope of the present invention. For example the invention is not limited by the size and shape of the bagging area. For example the bagging area could have rounded sides, and/or be the same width as the conveyor. Further for example the boundary of the bagging area could provide for some partitioning of sections of the bagging area.

Further the invention does not specify a means for conveying items to the bagging area nor a means for obtaining a price for items. Accordingly the invention is not limited to use of a conveyor belt or a scanning device.

Further the invention is not limited to two bagging sections and a skilled person will realize that the invention also applies to checkout systems with two or more sections. For example in a checkout system with three bagging sections two flexible dividers would be used.

In summary the present invention provides a checkout system which comprises an item accumulation (bagging) area which is partitioned into two or more sections using a flexible divider. The flexible divider extends from the entry zone of the accumulation area to a point on the boundary of the accumulation zone, but is longer than required to achieve this. When items are introduced into one section of the bagging area, if the items push against the flexible divider, for example due to weight of numbers, the divider flexes into the other section thereby making more space available in the current section for the items. Optionally the flexible divider is movable between two positions in the entry zone such that it further acts as a diverter for diverting items into one or other of the two sections and preferably a motor is used to automatically perform the movement.

We claim:

1. A checkout system comprising:

a checkout scanning area;

an accumulation area for the accumulation of items fed from the checkout scanning area, the accumulation area having an entry zone through which items enter the accumulation area and a boundary to retain items in the accumulation area;

an elongate flexible divider coupled at one end to the boundary, the divider for partitioning the accumulation area into two partitions;

a motor coupled to the other end of the flexible divider and configured to move the flexible divider between the two partitions for directing items from the entry zone into one or the other of the partitions;

wherein the flexibility of the divider enables the relative sizes of the two partitions to be varied to accommodate a variable number of items and an end of the flexible divider is mounted using a retraction mechanism which houses an extension section of the flexible divider, wherein the extension section is dispensed when a force is applied to the flexible divider and retracted when the force is removed.

2. The checkout system of claim 1 wherein the end of the flexible divider coupled to the boundary is moveable between two positions along the boundary.

3. The checkout system of claim 1 wherein the flexible divider comprises a plastic strip which is corrugated substantially perpendicular to its length.

4. The checkout system of claim 1 wherein the flexible divider comprise a flexible middle section with rigid sections at each end.

5. The checkout system of claim 1 wherein the flexible divider comprises a plurality of alternate rigid and flexible sections.

6. The checkout system of claim 5 wherein at least one flexible section comprises an elastic material.

* * * * *